US009405243B2

(12) United States Patent
Ogura

(10) Patent No.: US 9,405,243 B2
(45) Date of Patent: Aug. 2, 2016

(54) IMAGE HEATING APPARATUS AND HEATER USED IN THE SAME

(71) Applicant: CANON KABUSHIKI KAISHA, Tokyo (JP)

(72) Inventor: Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 14/083,705

(22) Filed: Nov. 19, 2013

(65) Prior Publication Data

US 2014/0138372 A1 May 22, 2014

(30) Foreign Application Priority Data

Nov. 21, 2012 (JP) ..... 2012-255368

(51) Int. Cl.

| | |
|---|---|
| ***G03G 15/20*** | (2006.01) |
| ***H05B 1/02*** | (2006.01) |
| ***H05B 3/22*** | (2006.01) |
| ***H05B 3/30*** | (2006.01) |
| *H05B 3/26* | (2006.01) |

(52) U.S. Cl.

CPC ..... *G03G 15/2042* (2013.01); *G03G 15/2053* (2013.01); *G03G 2215/2035* (2013.01); *H05B 3/22* (2013.01); *H05B 3/262* (2013.01); *H05B 3/30* (2013.01)

(58) Field of Classification Search

None

See application file for complete search history.

(56) References Cited

U.S. PATENT DOCUMENTS

| | | | | |
|---|---|---|---|---|
| 2015/0055994 | A1* | 2/2015 | Shoji | G03G 15/2053 399/329 |
| 2015/0139706 | A1* | 5/2015 | Fujiwara | G03G 15/2064 399/329 |
| 2015/0139707 | A1* | 5/2015 | Suzumi | G03G 15/2042 399/329 |
| 2015/0139708 | A1* | 5/2015 | Shimura | G03G 15/2042 399/329 |
| 2015/0147101 | A1* | 5/2015 | Nakayama | G03G 15/2057 399/329 |
| 2015/0153692 | A1* | 6/2015 | Matsubara | G03G 15/2042 399/329 |

FOREIGN PATENT DOCUMENTS

| | | |
|---|---|---|
| JP | 2003-007435 A | 1/2003 |
| JP | 2003-317898 A | 11/2003 |
| JP | 2004-252301 A | 9/2004 |
| JP | 2008-216741 A | 9/2008 |

* cited by examiner

*Primary Examiner* — Joseph M Pelham

(74) *Attorney, Agent, or Firm* — Canon USA, Inc. I.P. Division

(57) ABSTRACT

An image heating apparatus or a heater used in the image heating apparatus includes a thermally conductive anisotropic sheet provided on one surface of the heater on which a temperature detection member is provided. The sheet is not provided at a portion of the heater where the temperature detection member is provided, or the thickness of the sheet is reduced at a portion where the temperature detection member is provided compared to the thickness thereof in the surrounding area of the portion. Accordingly, responsiveness of the temperature detection member is improved.

31 Claims, 14 Drawing Sheets

FIG.10A

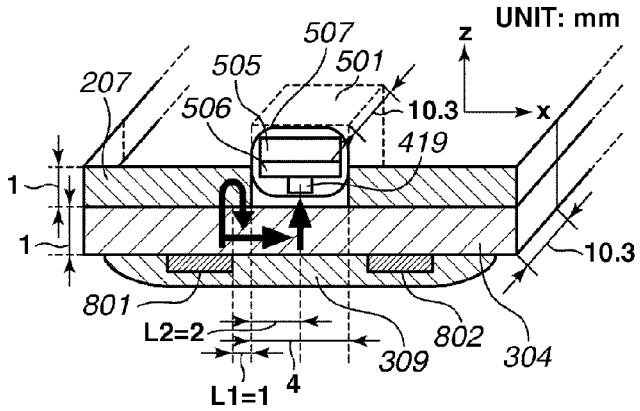

FIG.10B

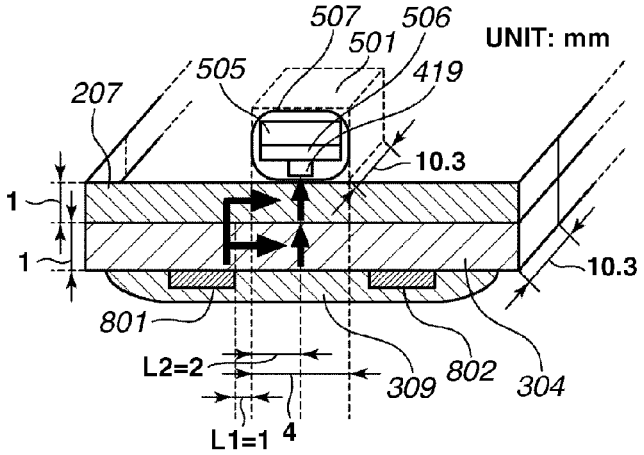

FIG.10C

| | |
|---|---|
| THERMAL CONDUCTIVITY OF INSULATING SUBSTRATE 304 | 25 W/(m·K) |
| THERMAL CONDUCTIVITY OF GRAPHITE SHEET 207 (x DIRECTION) | 700 W/(m·K) |
| THERMAL CONDUCTIVITY OF GRAPHITE SHEET 207 (z DIRECTION) | 3 W/(m·K) |
| CROSS-SECTIONAL AREA: z DIRECTION | $10.3 \times 4$ mm$^2$ |
| CROSS-SECTIONAL AREA: INSULATING SUBSTRATE 304 ALONG x DIRECTION | $10.3 \times 1$ mm$^2$ |
| CROSS-SECTIONAL AREA: GRAPHITE SHEET 207 ALONG x DIRECTION | $10.3 \times 1$ mm$^2$ |

FIG.10D

| | | (a) | (b) |
|---|---|---|---|
| THERMAL RESISTANCE IN L (= L1 + L2) (x DIRECTION) | | 7900.9 | 401.7 |
| BREAKDOWN | (THERMAL RESISTANCE IN L1) | 133.9 | — |
| | (THERMAL RESISTANCE IN L2) | 7767.0 | — |
| THERMAL RESISTANCE OF INSULATING SUBSTRATE 304 (z DIRECTION) | | 970.9 | 970.9 |
| THERMAL RESISTANCE OF GRAPHITE SHEET 207 (z DIRECTION) | | — | 8090.6 |
| TOTAL THERMAL RESISTANCE | | 8871.78 | 9463.23 |

UNIT: K/W

IMAGE HEATING APPARATUS AND HEATER USED IN THE SAME

BACKGROUND OF THE INVENTION

1. Field of the Invention

The present disclosure relates to image heating apparatuses configured to heat images formed on recording materials and to heaters used in the image heating apparatuses.

2. Description of the Related Art

Image heating apparatuses are provided in image forming apparatuses such as a copying machine and a printer to serve as fixing apparatuses. An image heating apparatus that includes an endless belt, a ceramic heater, which makes contact with an inner surface of the endless belt, and a pressure roller, which, along with the ceramic heater, forms a fixing nip portion with the endless belt provided therebetween, is one of such image heating apparatuses. Continuous printing on small-sized sheets with an image forming apparatus that includes such an image heating apparatus causes the temperature of an area in a lengthwise direction of the fixing nip portion where the sheets do not pass through to gradually rise (i.e., non-sheet-passing part temperature rise). An excessive rise in the temperature of a non-sheet-passing part may cause damage to parts in an apparatus, or printing on a large-sized sheet with the temperature of the non-sheet-passing part remaining high may cause toner on the area corresponding to the non-sheet-passing part of the small-sized sheets to be overheated and be offset onto the belt (i.e., high temperature offset).

Japanese Patent Application Laid-Open No. 2003-317898 and Japanese Patent Application Laid-Open No. 2003-007435 discuss a method of providing a thermally conductive anisotropic layer such as graphite on a ceramic heater to suppress the non-sheet-passing part temperature rise. Graphite has a layered structure of hexagonal plate crystal formed of carbon, and the layers are bonded by the van der Waals force. Graphite has higher thermal conductivity in a direction parallel to the surface of the ceramic heater (i.e., direction parallel to the plane of a covalently bonded layer in graphite). Thus, providing graphite on a ceramic substrate enables the rise in the temperature of a non-sheet-passing part of small-sized sheets to be suppressed.

Furthermore, graphite has low thermal conductivity in the thickness direction thereof (i.e., direction perpendicular to the plane of the covalently bonded layer in graphite). Thus, heat dissipation to a holder supporting the ceramic heater can be suppressed, and heat can be efficiently provided to paper.

Bringing a temperature detection member into contact with a ceramic heater to detect the temperature of the ceramic heater is a generally used method. Graphite, however, has low thermal conductivity in the thickness direction thereof. Thus, when the temperature of the ceramic heater is detected with a thermally conductive anisotropic layer such as graphite provided therebetween, there is a delay in response of the temperature detection member.

SUMMARY OF THE INVENTION

The present invention is directed to an image heating apparatus and a heater with improved responsiveness in temperature detection while alleviating the non-sheet-passing part temperature rise during fixing processing of small-sized sheets.

According to an aspect of the present disclosure, an image heating apparatus includes a plate-shaped heater, and a temperature detection member configured to detect a temperature of the heater. In such an image heating apparatus, a thermally conductive anisotropic sheet having greater thermal conductivity in a plane direction thereof than that in a thickness direction thereof is provided on one surface of the heater where the temperature detection member is provided. Further, the sheet is not provided at a portion of the heater where the temperature detection member is provided, or the sheet has a reduced thickness at a portion where the temperature detection member is provided compared to the thickness thereof in a surrounding area of the portion.

According to another aspect of the present disclosure, a heater used in an image heating apparatus includes a plate-shaped substrate. In such a heater, a thermally conductive anisotropic sheet having greater thermal conductivity in a plane direction thereof than that in a thickness direction thereof is provided, and the sheet is not provided at a portion of the substrate where a temperature detection member for detecting a temperature of the heater is provided, or the sheet has a reduced thickness at a portion where the temperature detection member is provided compared to the thickness thereof in a surrounding area of the portion.

Further features of the present invention will become apparent from the following description of exemplary embodiments with reference to the attached drawings.

BRIEF DESCRIPTION OF THE DRAWINGS

FIGS. 10A, 10B, 10C, and 10D are diagrams illustrating thermal resistance in portions leading to a temperature detection member in cases where part of the thermally conductive anisotropic member is cut out and is not cut out.

DESCRIPTION OF THE EMBODIMENTS

Figure 1:
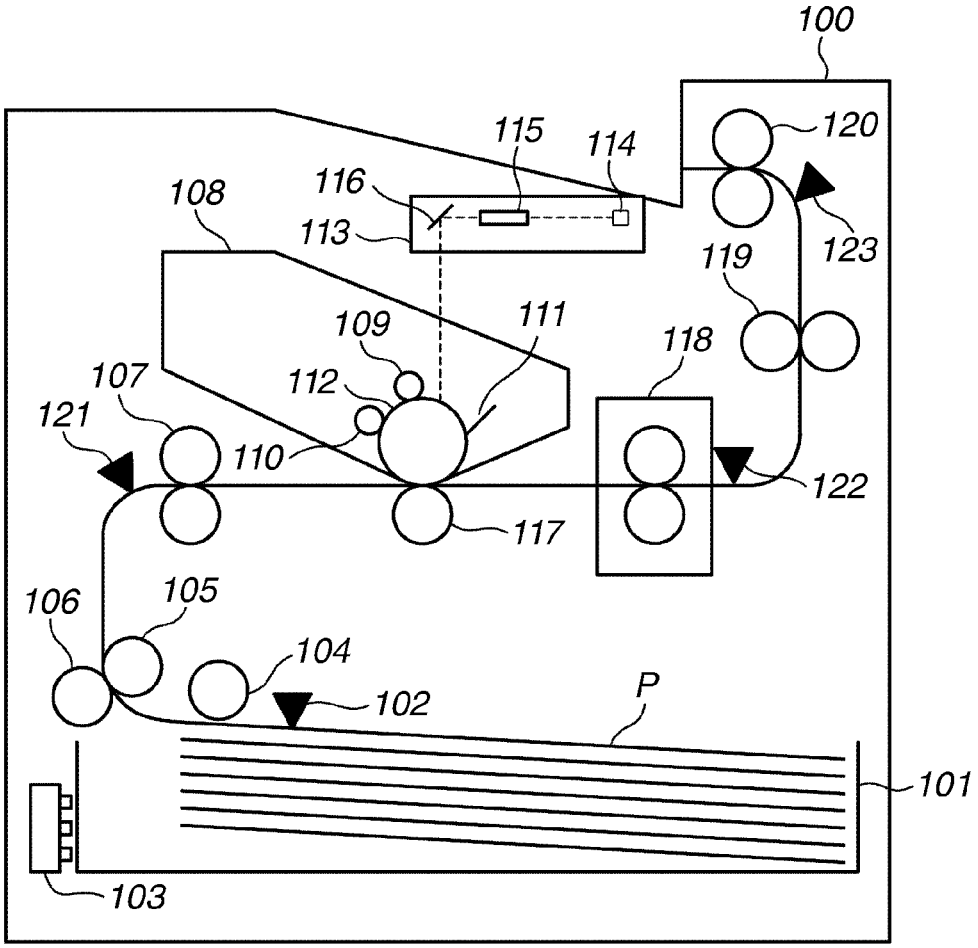
FIG. 1 illustrates a configuration of an image forming apparatus.

FIG. 1 illustrates a configuration of an image forming apparatus 100 that includes an image heating apparatus, which serves as a fixing apparatus according to a first exemplary embodiment. The image forming apparatus 100 includes a paper feed cassette 101, a paper presence detection sensor 102, and a paper size detection sensor 103. The paper feed cassette 101 stores a recording sheet P serving as a recording material, the paper presence detection sensor 102 detects whether the recording sheet P is present, and the paper size detection sensor 103 detects the size of the recording sheet P. The image forming apparatus 100 further includes a pickup roller 104, a paper feeding roller 105, and a retard roller 106. The pickup roller 104 sends out the recording sheets P stacked in the paper feed cassette 101, the paper feeding roller 105 conveys the recording sheets P that have been sent out by the pickup roller 104, and the retard roller 106, which is disposed opposite the paper feeding roller 105, feeds the recording sheets P sheet by sheet. The recording sheet P is then conveyed by registration rollers 107 at a predetermined timing. A process cartridge 108 is integrally formed of a charging roller 109, a developing roller 110, a cleaner 111, and a photosensitive drum 112, which serves as an electrophotographic photosensitive member.

The surface of the photosensitive drum 112 is charged uniformly by the charging roller 109, and then an image is exposed thereon by a scanner unit 113 in accordance with an image signal. A laser diode 114 in the scanner unit 113 emits a laser beam. The laser beam is steered by a rotating polygon mirror 115 and a reflection mirror 116 to scan in a main scanning direction, and the rotation of the photosensitive drum 112 causes the laser beam to also scan in a sub-scanning direction. Thus, a two-dimensional latent image is formed on the surface of the photosensitive drum 112. The latent image on the photosensitive drum 112 is visualized by the developing roller 110 in the form of a toner image, and the toner image is then transferred by a transfer roller 117 onto a recording sheet P that has been conveyed by the registration rollers 107. The recording sheet P, on which the toner image has been transferred, is then conveyed to a fixing apparatus 118, in which the recording sheet P undergoes heating/pressing processing. Thus, an unfixed toner image is fixed onto the recording sheet P. The recording sheet P is then discharged outside the image forming apparatus 100 by intermediate paper discharge rollers 119 and paper discharge rollers 120, and thus a series of print operations ends. A pre-registration sensor 121, a fixing paper discharge sensor 122, and a paper discharge sensor 123 monitor the conveyance condition of the recording sheets P.

Figure 2:
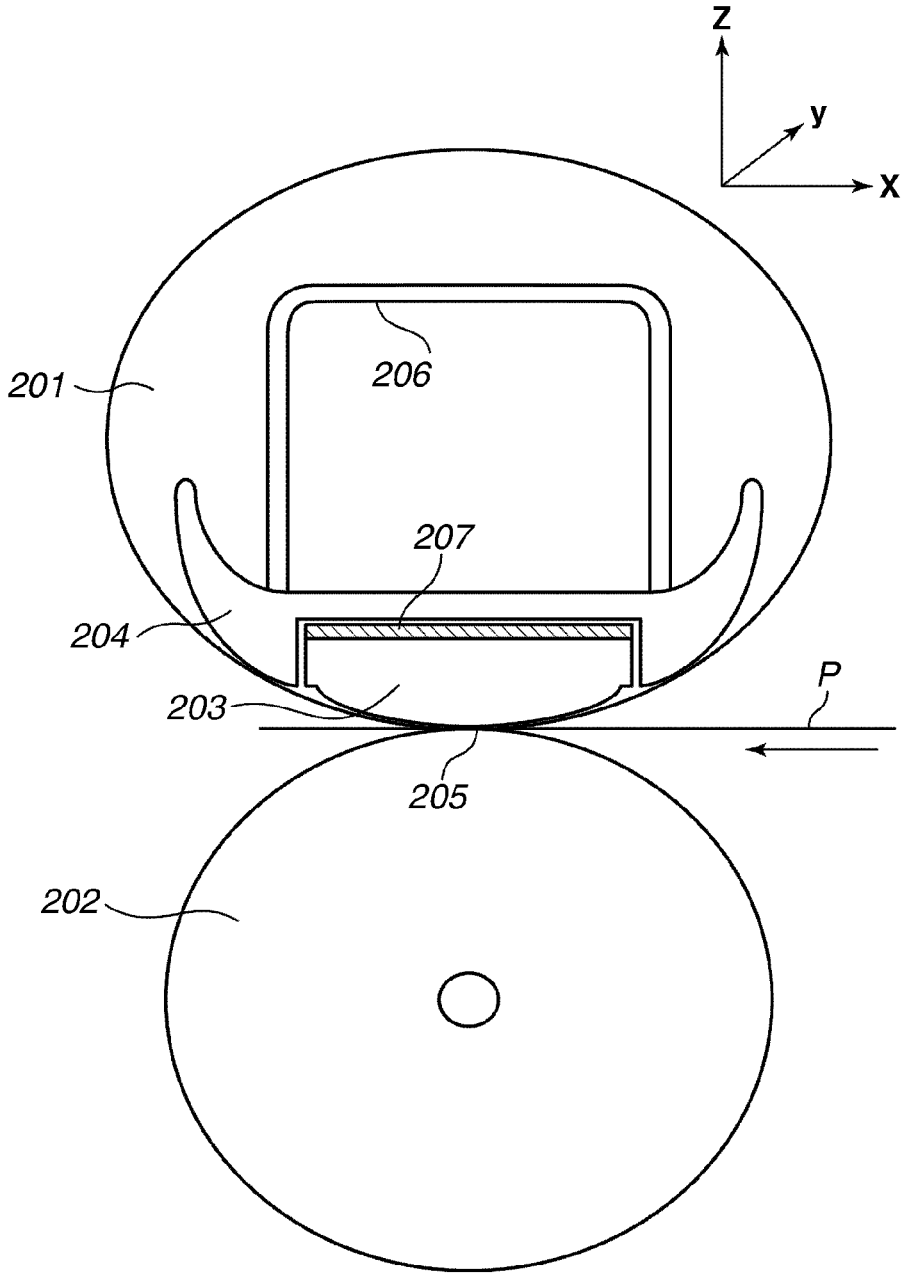
FIG. 2 is a sectional view of a fixing apparatus.

FIG. 2 is a sectional view illustrating the configuration of the fixing apparatus 118. The fixing apparatus 118 includes a cylindrical fixing film (endless belt) 201, a heater 203, and a nip portion forming member (pressure roller) 202. The heater 203 makes contact with an inner surface of the fixing film 201, and the nip portion forming member 202, along with the heater 203, forms a nip portion 205 with the fixing film 201 provided therebetween. The nip portion 205 nips and conveys the recording sheet P carrying an image. The fixing apparatus 118 further includes a heater holder 204 formed of heat-resistant resin and a stay 206 formed of metal. The heater holder 204 holds the heater 203, and the stay 206 is provided in parallel to the lengthwise direction of the heater holder 204 for ensuring rigidity of the heater holder 204. The heater 203 is in contact with a temperature detection member that detects the temperature of the heater 203. As described above, the fixing apparatus 118 includes the endless belt 201, the heater 203, and the nip portion forming member 202. The heater 203 makes contact with the inner surface of the endless belt 201, the nip portion forming member 202, along with the heater 203, forms the nip portion 205 with the endless belt 201 provided therebetween, and the nip portion 205 nips and conveys the recording sheet P carrying an image. The fixing apparatus 118 further includes the temperature detection member that detects the temperature of the heater 203. The temperature detection member is provided on a second surface of the heater 203 which is opposite a first surface thereof forming the nip portion 205.

A thermally conductive anisotropic member 207 is provided on a rear surface of the heater 203 (i.e., the surface (the second surface) that is opposite the surface (first surface) that forms the nip portion 205). In the first exemplary embodiment, the thermally conductive anisotropic member 207 is a sheet formed of graphite. Graphite has a layered structure of hexagonal plate crystal formed of carbon, and the layers are bonded by the van der Waals force. Graphite, having such a structure, has very high thermal conductivity in a direction parallel to the layer plane (sheet plane) while it has lower thermal conductivity in a direction perpendicular to the layer plane (sheet plane) than that in the direction parallel thereto. In FIG. 2, a direction x is a widthwise direction of the fixing apparatus 118 (i.e., the widthwise direction of the heater 203), a direction y is a lengthwise direction of the fixing apparatus 118 (i.e., the lengthwise direction of the heater 203), and a direction z is a heightwise direction of the fixing apparatus 118.

As illustrated in FIG. 2, the graphite sheet 207 is located between the heater holder 204 and the heater 203. The graphite sheet 207 in the first exemplary embodiment is 100 μm in thickness and has thermal conductivity of 700 W/(m·K) in a direction parallel to the sheet plane and 3 to 10 W/(m·K) in the thickness direction thereof (i.e., the direction perpendicular to the sheet plane). In the first exemplary embodiment, the heater 203 and the graphite sheet 207 are not integrated with an adhesive, but the graphite sheet 207 is simply sandwiched between the heater holder 204 and the heater 203. When such a configuration is employed, grease (not illustrated) having high thermal conductivity may be applied between the graphite sheet 207 and the heater 203 to retain the relative position of the heater 203 and the graphite sheet 207.

As described above, the graphite sheet 207 is not affixed to either the heater 203 or the heater holder 204, and the graphite sheet 207 is simply sandwiched between the heater 203 and the heater holder 204. In other words, the graphite sheet 207 is a separate component from the heater 203 and the heater holder 204. The graphite sheet 207, however, may be affixed to the heater holder 204, and the heater 203 may be pressed toward the heater holder 204 so that the heater 203 makes contact with the graphite sheet 207. Alternatively, the graphite sheet 207 may be affixed to the heater 203 with an adhesive having high thermal conductivity, and the heater 203, to which the graphite sheet 207 has been affixed, may be held onto the heater holder 204 without being affixed thereto. As another alternative, the heater 203, to which the graphite sheet 207 has been affixed, may be affixed to the heater holder 204 with an adhesive.

Figure 3A:
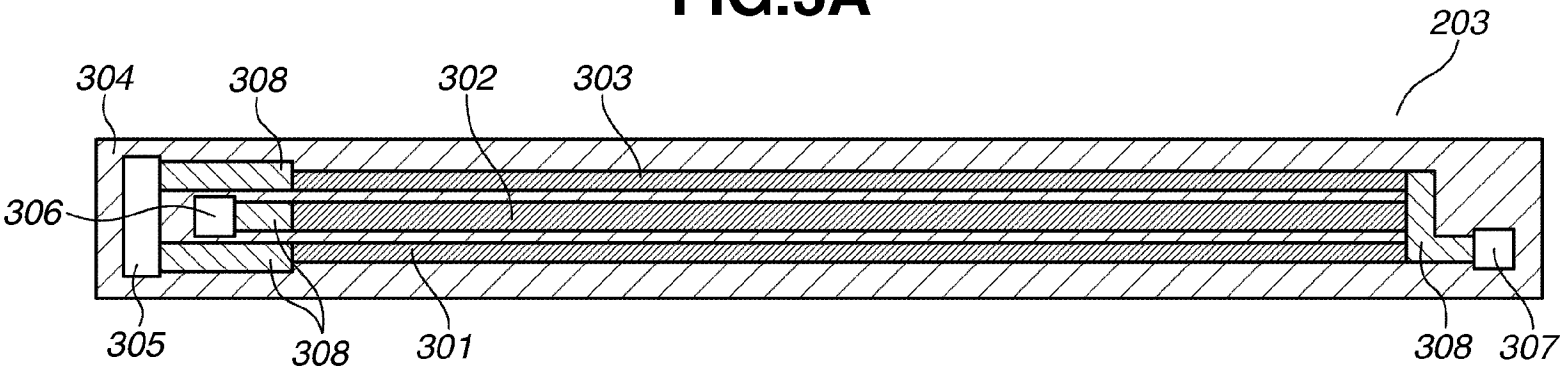
FIGS. 3A and 3B are diagrams illustrating a ceramic heater according to a first exemplary embodiment.
Figure 3B:
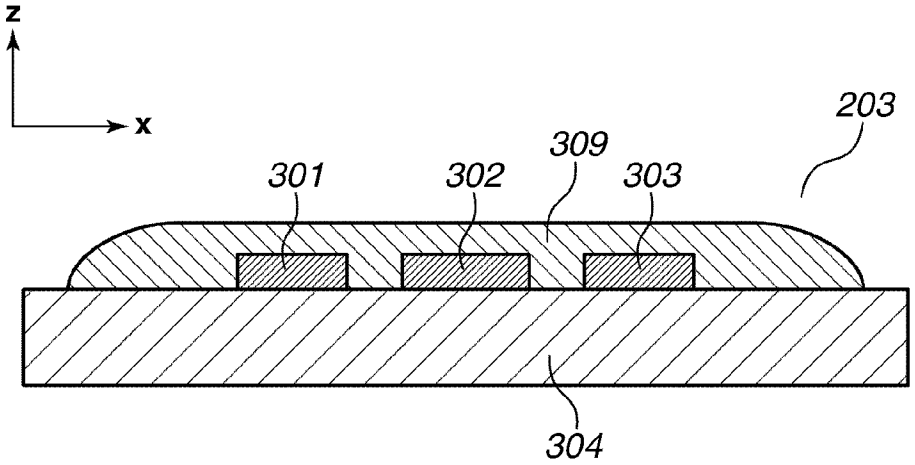

FIGS. 3A and 3B are diagrams illustrating the heater 203 according to the first exemplary embodiment. FIG. 3A is a top view of the heater 203, and FIG. 3B is a sectional side view of the heater 203 as viewed in the lengthwise direction thereof.

The heater 203 includes an insulating substrate 304, heat generating resistors 301, 302, and 303, electrically-conductive portions 308, electrode portions 305, 306, and 307, and a protective layer (glass) 309. The insulating substrate 304 is formed of ceramics such as silicon carbide (SiC), aluminum nitride (AlN), and aluminum oxide ($Al_2O_3$), the heat generating resistors 301, 302, and 303 are formed by printing paste on the surface of the insulating substrate 304, and the protective layer 309 protects the heat generating resistors 301, 302, and 303. As illustrated in FIG. 3A, the heat generating resistors 301 and 303 are connected in parallel with the heat generating resistor 302 provided therebetween. The heat generating resistors 301 and 303 are driven by a triac 403 illustrated in FIG. 4, and the heat generating resistor 302 is driven by a triac 404 illustrated in FIG. 4. The triacs 403 and 404 can be driven independently from each other. Thus, the heater 203 of the first exemplary embodiment is a dual drive heater, which is driven by the two triacs 403 and 404 that can be driven independently from each other.

The resistance value of each of the heat generating resistors 301 and 303 is set so that a larger amount of heat is generated at the center of the ceramic heater 203 than that generated at ends thereof in the lengthwise direction. The resistance value of the heat generating resistor 302, meanwhile, is set so that a larger amount of heat is generated at the ends of the ceramic heater 203 in the lengthwise direction than that generated at the center thereof. The set of the heat generating resistors 301 and 303 can be driven independently from the heat generating resistor 302, and thus a heat generation distribution in the heater 203 can be modified, for example, in accordance with the width of a recording material.

Figure 4:
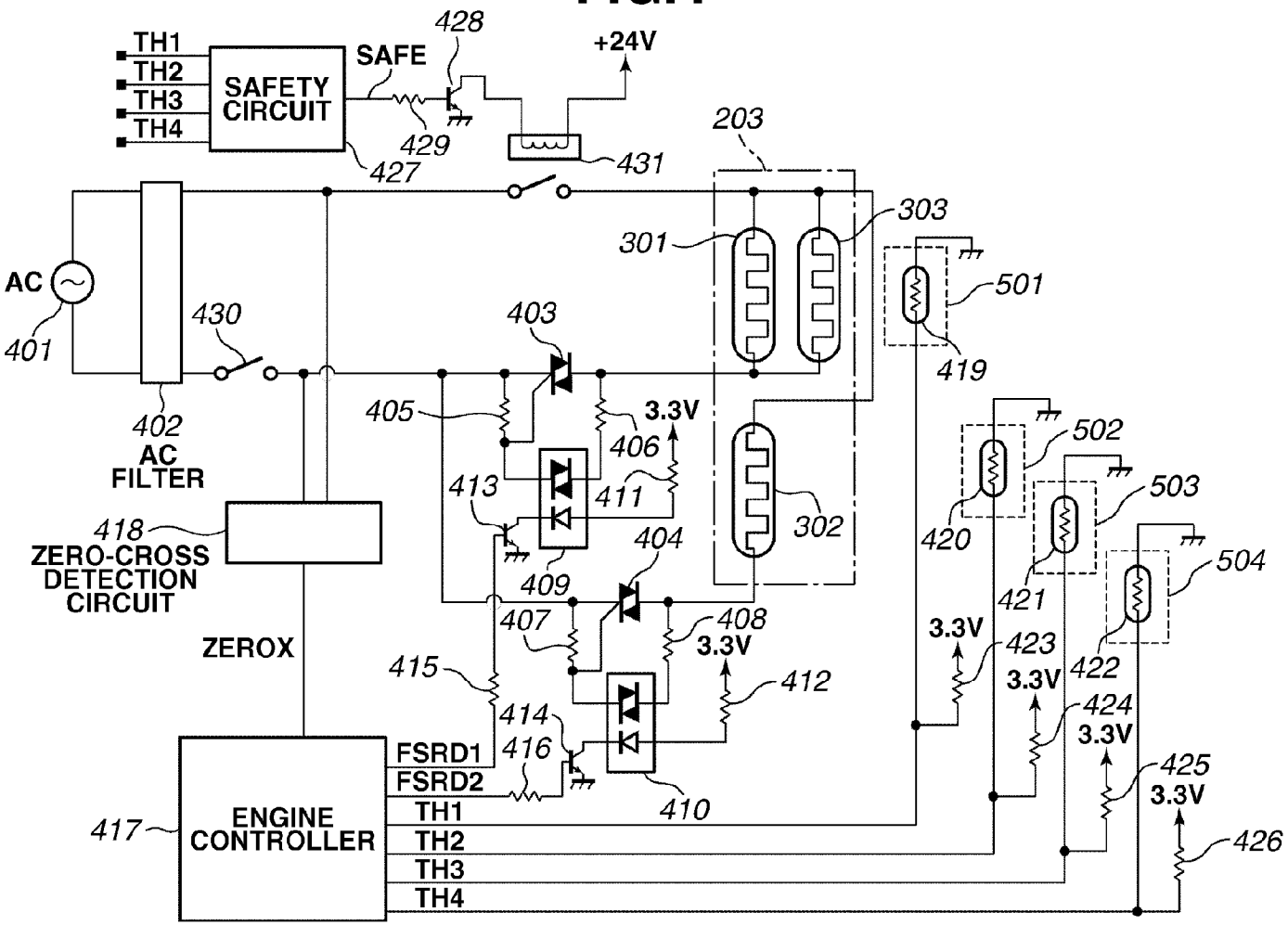
FIG. 4 illustrates a drive circuit of a heater.

FIG. 4 illustrates a heater drive circuit. The heater drive circuit includes an alternate current (AC) power supply 401, which is connected to the heat generating resistors 301, 302, and 303 through an AC filter 402. The power supplied to the heat generating resistors 301 and 303 is controlled by controlling the drive of the triac 403, and the power supplied to the heat generating resistor 302 is controlled by controlling the drive of the triac 404. Bias resistors 405 and 406 drive the triac 403, and bias resistors 407 and 408 drive the triac 404. Phototriac couplers 409 and 410 secure a creeping distance between a primary side and a secondary side. When electric current flows through light emitting diodes of the respective phototriac couplers 409 and 410, the triacs 403 and 404 are turned on, respectively. Resistors 411 and 412 regulate the electric current in the phototriac couplers 409 and 410, respectively. Transistors 413 and 414 control on/off states of the phototriac couplers 409 and 410, respectively. The transistors 413 and 414 operate in accordance with respective heater drive signals FSRD1 and FSRD2 transmitted from an engine controller 417 through resistors 415 and 416, respectively. The heater drive signals FSRD1 and FSRD2 are set to an "H" level to turn on the triacs 403 and 404 and are set to an "L" level to turn off the triacs 403 and 404. The "H" level, which is a voltage level of a port of the engine controller 417, indicates a voltage level that is close to the level of the voltage supplied to the engine controller 417. The "L" level, meanwhile, indicates a voltage level that is close to a ground potential of the engine controller 417. A zero-cross detection circuit 418 is connected to the AC power supply 401 through the AC filter 402. The zero-cross detection circuit 418 transmits a pulse signal (hereinafter, referred to as a "ZEROX signal") to the engine controller 417 to notify that the commercial power supply voltage has reached or fallen below a threshold voltage. In the image forming apparatus 100, the engine controller 417 determines timings of passing the electricity to the respective triacs 403 and 404 based on pulse edges of the ZEROX signal to control the on/off states of the triacs 403 and 404.

A thermistor element 419 detects the temperature of the ceramic heater 203 at a center portion thereof in the lengthwise direction. Thermistor elements 420, 421, and 422 detect the temperature of the ceramic heater 203 at end portions thereof in the lengthwise direction. The temperatures detected by the thermistor elements 419, 420, 421, and 422 are input to the engine controller 417. Resistors 423, 424, 425, and 426 divide the voltages of outputs from the respective thermistor elements 419, 420, 421, and 422. Thus, TH1, TH2, TH3, and TH4 signals, which each have undergone voltage division and analog to digital conversion, are input to the engine controller 417. The thermistor elements 419, 420, 421, and 422 are negative temperature coefficient (NTC) thermistors with such properties that resistance values thereof decrease as the temperature rises. Therefore, the voltages of the TH1, TH2, TH3, and TH4 signals decrease as the temperatures of the respective thermistor elements 419, 420, 421, and 422 rise. The temperature of the ceramic heater 203 is monitored by the engine controller 417 and is compared with a target temperature set in the engine controller 417. Thus, the power to be supplied to the heat generating resistors 301, 302, and 303 is adjusted. Through this configuration, the power supplied to the heater 203 is controlled to maintain the heater 203 at the target temperature.

A safety circuit 427 detects malfunctioning of the fixing apparatus 118 and forcibly stops the power supply to the ceramic heater 203. The TH1, TH2, TH3, and TH4 signals from the respective thermistor elements 419, 420, 421, and 422 are also input to the safety circuit 427 without passing through the engine controller 417. The safety circuit 427 compares the temperatures detected by the thermistor elements 419, 420, 421, and 422 with a reference temperature, which serves as a reference for determining malfunctioning of the fixing apparatus 118. If the temperatures detected by the thermistor elements 419, 420, 421, and 422 fall below the reference temperature, the safety circuit 427 retains an output signal SAFE at an "H" level. If the temperatures detected by the thermistor elements 419, 420, 421, and 422 exceed the reference temperature, the safety circuit 427 sets the output signal SAFE to an "L" level to turn off a transistor 428.

A relay 431, where a primary side and a secondary side are insulated from each other, includes a switch unit, and the switch unit is disposed in a power supply path from the AC power supply 401 to the heat generating resistors 301, 302, and 303. When the transistor 428 causes electric current to flow through a built-in coil connected to the secondary side of the relay 431, the coil is excited, and the switch unit is turned on/off. The transistor 428 is connected to the safety circuit 427 through a resistor 429. When the fixing apparatus 118 malfunctions, the relay 431 is turned off to stop the power supply to the ceramic heater 203.

A thermostatic switch 430 is in contact with the ceramic heater 203. The contact of the thermostatic switch 430 breaks when the operating temperature thereof exceeds a predetermined temperature, shutting off the power supply to the heater 203. The thermostatic switch 430 has its operating temperatures set such that the power supply to the heater 203 stops when the temperature of the heater 203 rises to an abnormal temperature and is used as a protective element of the fixing apparatus 118. The thermostatic switch 430 and the relay 431 operate independently from each other when the fixing apparatus 118 malfunctions, enhancing safety of the fixing apparatus 118.

Figure 5:
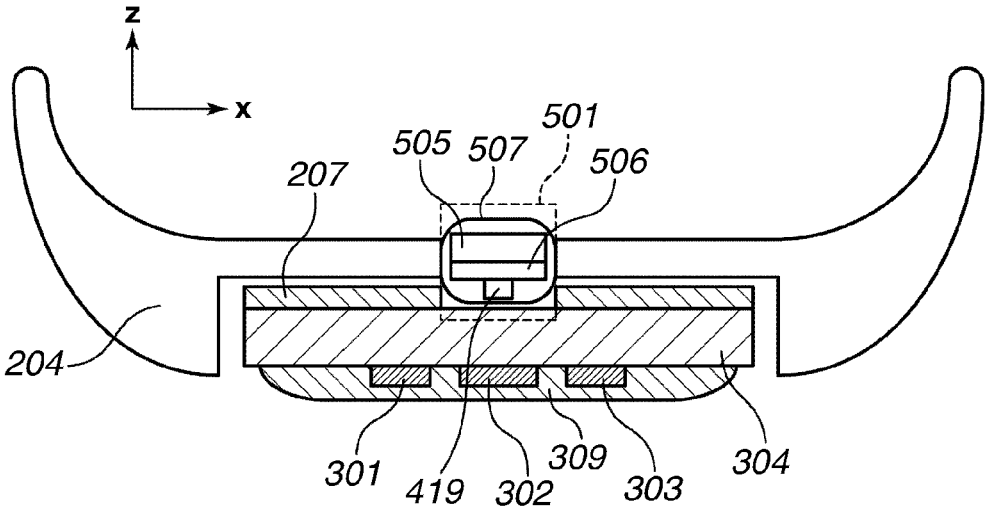
FIG. 5 is a sectional view illustrating the shape of a thermally conductive anisotropic member according to the first exemplary embodiment.

FIG. 5 is a diagram illustrating the shape of the graphite sheet 207 in a temperature detection unit. FIG. 5 illustrates the positional relationship among the ceramic heater 203, the graphite sheet 207, a thermistor unit (temperature detection member) 501, which is indicated by a dotted rectangular in FIG. 4, and the heater holder 204. As illustrated in FIGS. 2 and 5, the ceramic heater 203 is disposed such that the protective layer 309 faces the nip portion 205 and the insulating substrate 304 is in contact with the graphite sheet 207. The thermistor unit 501 is in contact with the second surface (surface opposite the surface that faces the nip portion 205) of the ceramic heater 203. The thermistor unit 501 includes a hard resin 505, a ceramic paper 506 placed on the hard resin 505, and the chip-sized thermistor element 419 placed on the ceramic paper 506, all of which are then wrapped by an insulating film 507. A heat-sensitive plate may be attached to the thermistor element 419 to collect heat to the thermistor element 419. Such a temperature detection unit may be provided in a plurality in a single fixing apparatus 118. In the first exemplary embodiment, thermistor units 502, 503, and 504 that include the thermistor elements 420, 421, and 422, respectively, are further provided. In the first exemplary embodiment, the thermostatic switch 430 is also referred to as a temperature detection member.

The graphite sheet 207 has such a shape that a portion through which the temperature detection member makes contact with the heater 203 is cut out. In other words, the thermally conductive anisotropic member, which has higher thermal conductivity in a direction parallel to the second surface of the heater 203 than that in a direction perpendicular to the second surface, is provided on the second surface, but such a thermally conductive anisotropic member is not provided at a portion of the heater 203 where the temperature detection member is disposed. Although the ceramic heater 203 is disposed such that a surface of the insulating substrate 304 on which the heat generating resistors 301, 302, and 303 are provided is opposite the nip portion 205 in the first exemplary embodiment, the ceramic heater 203 may instead be disposed such that a surface of the insulating substrate 304 on which the heat generating resistors 301, 302, and 303 are not provided is opposite the nip portion 205. In that case, a surface of the insulating substrate 304, the surface that is opposite the nip portion 205 may be coated with paste such as a polyimide in order to enhance slidability between the insulating substrate 304 and the fixing film 201. If such a configuration is employed, the graphite sheet 207 is disposed between the heater holder 204 and the protective layer 309 that is provided on a surface of the heater 203 on which the heat generating resistors 301, 302, and 303 are provided.

Figure 6A:
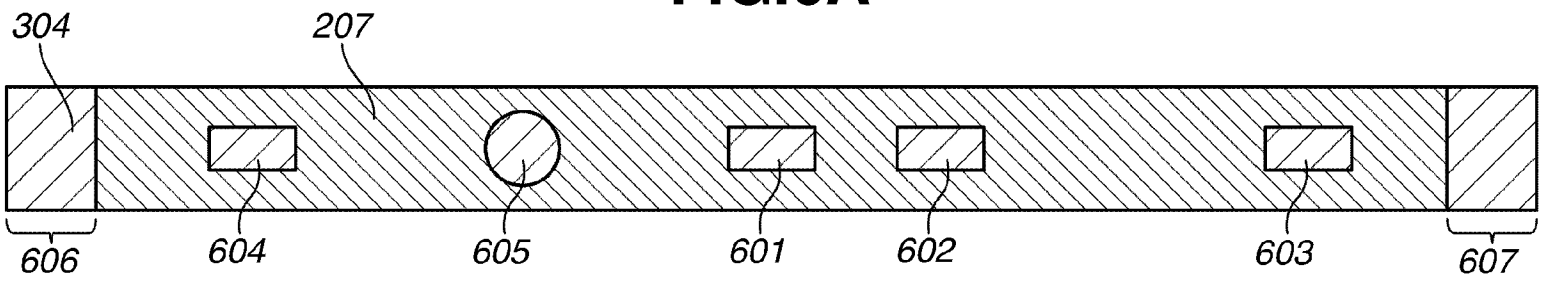
FIGS. 6A and 6B are plan views illustrating the shape of the thermally conductive anisotropic member according to the first exemplary embodiment.
Figure 6B:
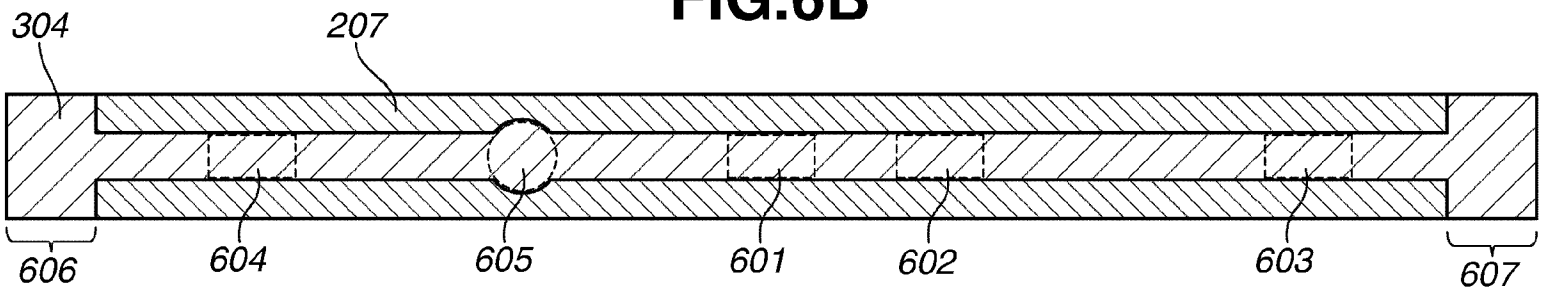

FIGS. 6A and 6B are diagrams illustrating the shape of the graphite sheet 207 in the lengthwise direction of the heater 203 according to the first exemplary embodiment. FIGS. 6A and 6B illustrate the graphite sheet 207 being placed on the ceramic heater 203.

With reference to FIG. 6A, the thermistor unit 501 makes contact with the ceramic heater 203 through a portion 601. Since the graphite sheet 207 is cut out by an area corresponding to a contact area between the thermistor unit 501 and the heater 203, the insulating substrate 304 is exposed therethrough. Similarly, the end portion thermistor units 502, 503, and 504 make contact with the ceramic heater 203 through portions 602, 603, and 604, respectively, and the graphite sheet 207 is cut out by areas corresponding to respective contact areas between the thermistor units 502, 503, and 504 and the heater 203. The thermostatic switch 430 serving as the protective element makes contact with the heater 203 through a portion 605, and the portion 605 is also cut out from the graphite sheet 207 by an area corresponding to a contact area between a heat-sensitive surface of the thermostatic switch 430 and the heater 203. The heater 203 is nipped by a power supply connector at portions 606 and 607, and the graphite sheet 207 is not provided at these portions 606 and 607 of the heater 203. The electrode portions 305, 306, and 307 illustrated in FIG. 3 are provided on rear surfaces of the portions 606 and 607, respectively. If heat from the heat generating resistors 301, 302, and 303 is conducted to the portions 606 and 607, the temperature of the connector rises excessively. Therefore, the graphite sheet 207 is not provided at the portions 606 and 607. The graphite sheet 207, however, is provided across almost the entire surface of the ceramic heater 203 except at the portions 606 and 607. Providing the graphite sheet 207 advantageously allows heat at the ends of the heater 203 in the lengthwise direction to dissipate to the center portion thereof in the lengthwise direction and to suppress the non-sheet-passing part temperature rise, and keeping the area of the heater 203 where the graphite sheet 207 is not provided to a minimum brings about such an advantage to a full extent. Alternatively, as illustrated in FIG. 6B, a line containing the portions 601, 602, 603, and 604, through which the thermistor units 501, 502, 503, and 504 make contact with the heater 203, and the portion 605, through which the thermostatic switch 430 makes contact with the heater 203, may be cut out. In other words, the thermally conductive anisotropic member may have an elongated shape in the lengthwise direction of the heater 203 and include portions where the temperature detection members for the heater 203 are disposed, and the portions where the temperature detection members are disposed may be cut out. In this case as well, the graphite sheet 207 is present continuously across the lengthwise direction of the heater 203, and thus the non-sheet-passing part temperature rise can be suppressed effectively. The ceramic heater 203 may be affixed to the heater holder 204 with an adhesive, and in such a case, the graphite sheet 207 may be cut out not only at the portions 601, 602, 603, and 604 through which the thermistor units 501, 502, 503, and 504 make contact with the heater 203 but also at a portion where the adhesive is applied.

Subsequently, the calculation result of thermal resistance from the heat generating resistor 302 to the thermistor element 419 will be described. When the thermal conductivity of the graphite sheet 207 in the z direction (FIG. 2) is 3 W/(m·K), the thickness of the graphite sheet 207 is 0.1 mm, and the area of a portion cut out from the graphite sheet 207, that is, the contact area between the thermistor unit 501 and the heater 203 in the first exemplary embodiment is $10.3\times4$ mm$^2$, thermal resistance of $8.09\times10^3$ K/W (Kelvin/Watt) is eliminated. The thermal resistance is calculated through an equation where thermal resistance (K/W)=thermal conductivity/distance/cross-sectional area. Cutting out a portion of the graphite sheet 207 to allow the temperature detection member to make contact with the heater 203 therethrough can eliminate a delay in thermal conduction in the thickness direction (z direction) of the graphite sheet 207, and thus heat from the heater 203 can be conducted quickly to the thermistor element 419.

Figure 7:
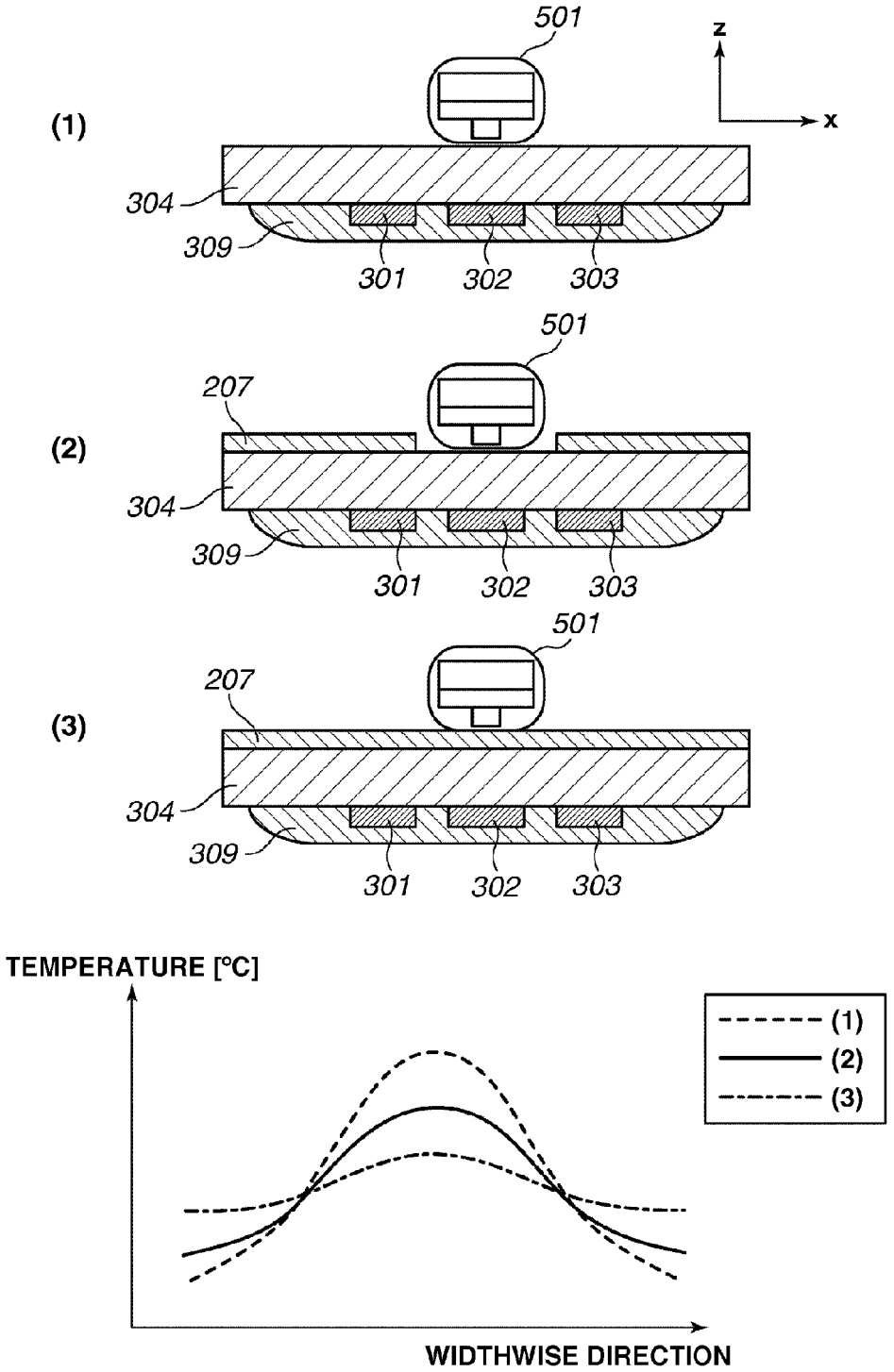
FIG. 7 illustrates temperature distributions in the ceramic heater.

FIG. 7 illustrates temperature distributions in the ceramic heater 203 while the temperature thereof rises. Cases where the graphite sheet 207 is not provided ((1)), the graphite sheet 207 is provided across the entire surface of the heater 203 ((3)), and the graphite sheet 207 is cut out by an area corresponding to the contact area between the thermistor unit 501 and the heater 203 as illustrated in FIGS. 5, 6A, and 6B ((2)) are compared.

The broken line indicates the temperature distribution in the case where the graphite sheet 207 is not provided ((1)). Since the heat generating resistors 301, 302, and 303 are concentrated toward the center of the ceramic heater 203 in the x direction, a maximum temperature appears at the center and the temperature decreases toward the ends. Meanwhile, with the configuration where the graphite sheet 207 is provided across the entire surface of the heater 203 ((3)), as indicated by the dashed-dotted line, heat around the heat generating resistors 301, 302, and 303, where a maximum temperature appears, is conducted to the ends of the graphite sheet 207. Thus, the difference in temperature between the center and the ends of the heater 203 in the x direction is reduced. When a portion of the graphite sheet 207 is cut out as in the case (2), the cut out portion can suppress heat dissipation toward the ends, where the temperature is lower, and thus the temperature at the center remains high.

Thus, the greater the cut out area is, the higher the temperature of the portion detected by the thermistor element 419. In other words, responsiveness of the thermistor element 419 improves. If, however, the difference in temperature between the center and the ends increases, thermal stress increases, leading to more stress on the ceramic heater 203. Therefore, the graphite sheet 207 is cut out only by an area corresponding to the contact area between the thermistor unit 501 and the heater 203 in the first exemplary embodiment. When the temperature rises with a temperature distribution as in the case (2), this indicates that the temperature rises quickly in the temperature detection unit. By eliminating influence of thermal resistance by an amount corresponding to the thickness of the graphite sheet 207, the highest thermal response speed to the thermistor element 419 is achieved. With the configuration of the first exemplary embodiment, the power of 1800 W was actually supplied to the ceramic heater 203, and the time taken for the thermistor element 419 to reach the temperature of 250° C. was compared in the cases (2) and (3). It took 2.490 seconds in the case (3) while it took 2.017 seconds in the case (2) to reach the same temperature.

As described thus far, cutting out a portion of the graphite sheet 207 to allow the temperature detection member to make contact with the heater 203 therethrough increases thermal response speed of the temperature detection member. As the temperature is detected more quickly, safety protective operation can be taken more quickly when protecting the fixing apparatus 118 with the engine controller 417 and the safety circuit 427.

The configurations of the image forming apparatus 100 and the fixing apparatus 118 according to a second exemplary embodiment are similar to those of the first exemplary embodiment. Identical components are given identical reference numerals, and description thereof will be omitted.

Figure 8A:
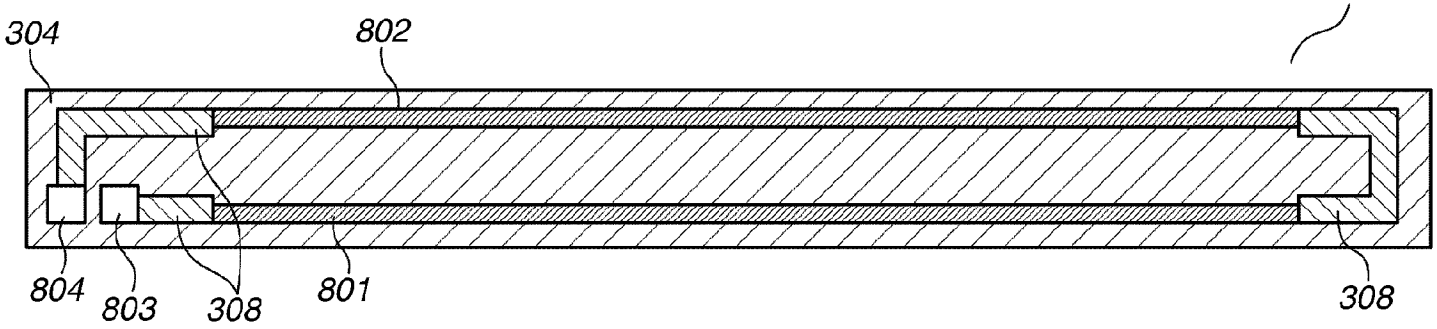
FIGS. 8A and 8B are diagrams illustrating a ceramic heater according to a second exemplary embodiment.
Figure 8B:
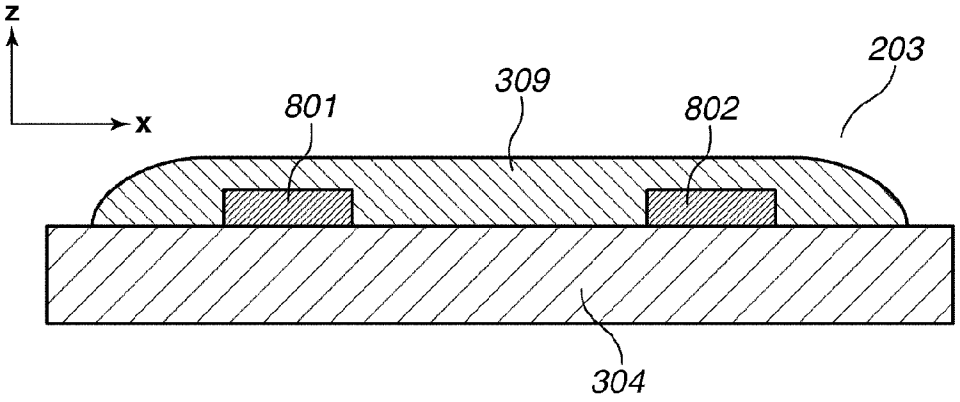

FIGS. 8A and 8B are diagrams illustrating the ceramic heater 203 according to the second exemplary embodiment. FIG. 8A is a top view of the ceramic heater 203, and FIG. 8B is a sectional view of the ceramic heater 203.

The second exemplary embodiment differs from the first exemplary embodiment in that the heater 203 is a single drive heater in which two heat generating resistors 801 and 802 are driven by a single triac. The insulating substrate 304 and the protective layer 309 illustrated in FIG. 8B are similar to those of the first exemplary embodiment, and thus description thereof will be omitted.

Figure 9:
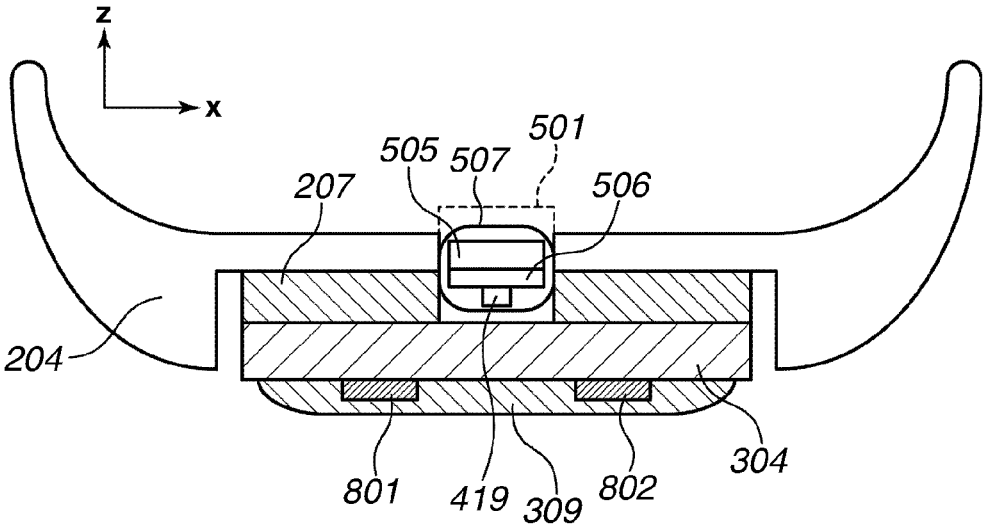
FIG. 9 is a sectional view illustrating the shape of a thermally conductive anisotropic member according to the second exemplary embodiment.

FIG. 9 is a sectional view illustrating the positional relationship among the ceramic heater 203, the graphite sheet 207, the thermistor unit 501, and the heater holder 204 taken along a plane intersecting the lengthwise direction of the heater 203 and containing the thermistor unit 501. In the second exemplary embodiment, the thickness of the graphite sheet 207 is 1 mm. The graphite sheet 207 has thermal conductivity of 700 W/(m·K) in a direction parallel to the sheet plane and 3 W/(m·K) in the thickness direction thereof. The graphite sheet 207 having a thickness of 1 mm may be formed by stacking graphite sheets each having a thickness of 100 μm. In the second exemplary embodiment as well, the graphite sheet 207 is cut out by an area corresponding to the contact area between the thermistor unit 501 and the heater 203, as illustrated in FIG. 9. In addition, in the second exemplary embodiment as well, the thermostatic switch 430 and the thermistor units 502, 503, and 504 used to detect the temperatures at the ends of the heater 203 are provided, and portions of the graphite sheet 207 through which these temperature detection members make contact with the heater 203 are cut out in a similar manner to that illustrated in FIG. 9. The shape of the graphite sheet 207 in the lengthwise direction of the heater 203 in the second exemplary embodiment is similar to the one illustrated in FIG. 6A or 6B, and thus description thereof will be omitted.

FIGS. 10A, 10B, 10C, and 10D illustrate a difference in thermal resistance between a configuration where a portion of the graphite sheet 207 is cut out and a configuration with no cutout in the graphite sheet 207. FIG. 10A illustrates the case with the cutout, whereas FIG. 10B illustrates the case without the cutout. The dimensions are indicated in FIGS. 10A and 10B. FIG. 10C illustrates the thermal conductivity and the cross-sectional areas of heat transmission paths used to calculate the thermal resistance. The thermal resistance is calculated through an equation where thermal resistance (K/W)=thermal conductivity/distance/cross-sectional area in a model where heat from the heat generating resistors 801 and 802 is conducted, in the end, to the contact surface of the thermistor unit 501 with the heater 203. As illustrated in FIG. 10A, the flow of heat from the heat generating resistor 801 to the thermistor element 419 is calculated separately in the x direction and the z direction. In that case, heat is conducted in two distinct directions, namely through the graphite sheet 207 and through the insulating substrate 304 in an area along the x direction where the graphite sheet 207 overlaps the insulating substrate 304 (e.g., area L1 in FIG. 10A). Therefore, the total thermal resistance in such an area is calculated under an assumption that each thermal resistance is connected in parallel. FIG. 10D illustrates a table indicating comparison results of the thermal resistance between the case illustrated in FIG. 10A and the case illustrated in FIG. 10B.

With the configuration illustrated in FIG. 10B, thermal resistance in the x direction is extremely small due to the effect of the graphite sheet 207. Thermal resistance, however, is still present in the z direction in the graphite sheet 207 immediately underneath the thermistor unit 501. Meanwhile, with the configuration illustrated in FIG. 10A, although thermal resistance in the x direction increases at the cut out portion, thermal resistance in the z direction in the graphite sheet 207 immediately underneath thermistor unit 501 is eliminated. Thus, the total thermal resistance from the heat generating resistors 801 and 802 to the thermistor unit 501 is smaller in the configuration illustrated in FIG. 10A than that in the configuration illustrated in FIG. 10B. The difference in the thermal resistance between the configuration illustrated in FIG. 10A and the configuration illustrated in FIG. 10B is a difference between the thermal resistance in the x direction and the thermal resistance in the z direction in an area L2. In other words, the speed of heat conduction to the thermistor element 419 can be increased by setting the total thermal resistance in the x direction in the area L2 to be smaller than the thermal resistance in the graphite sheet 207 in the z direction.

The thermal resistance above may be calculated while replacing with another parameter indicating ease of heat conduction such as thermal conductance or may be obtained through actual measurement.

Figure 11:
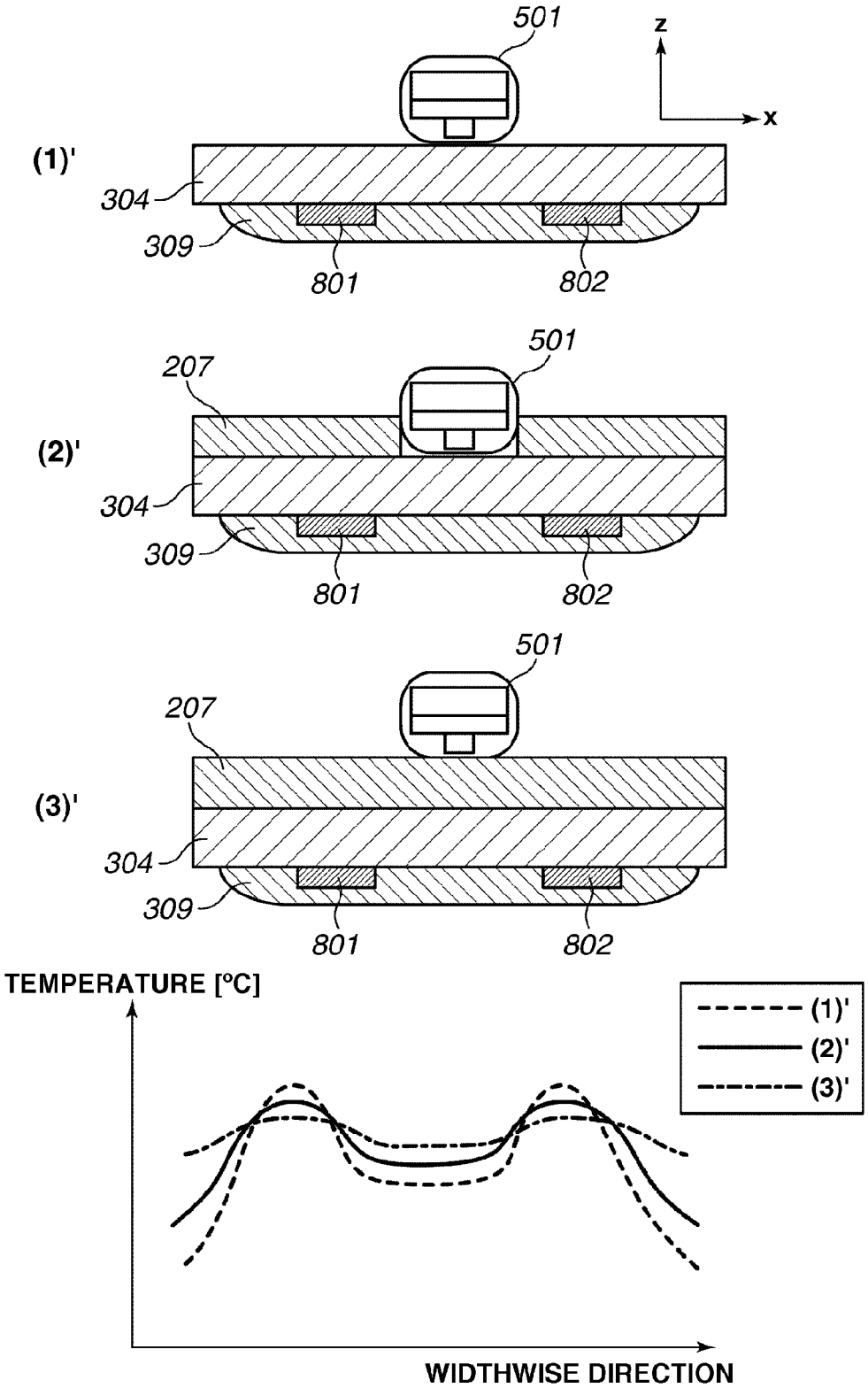
FIG. 11 illustrates temperature distributions of the ceramic heater according to the second exemplary embodiment.

FIG. 11 illustrates the temperature distributions in the ceramic heater 203 while the temperature thereof rises. Cases where the graphite sheet 207 is not provided at all ((1)'), the graphite sheet 207 is provided ((3)'), and the graphite sheet 207 that is cut out by an area corresponding to the contact area between the thermistor unit 501 and the heater 203 as illustrated in FIG. 9 is used ((2)') are compared. The broken line indicates the temperature distribution in the case where the graphite sheet 207 is not provided ((1)'). In this case, a difference in temperature between the portions corresponding to the locations of the heat generating resistors 801 and 802 and the ends of the heater 203 in the x direction (widthwise direction of the heater 203) is extremely large. Of course, suppression of the non-sheet-passing part temperature rise in the lengthwise direction of the heater 203, which is a direction perpendicular to the paper plane of FIG. 11, cannot be expected. Meanwhile, with the configuration where the graphite sheet 207 is provided across the entire surface ((3)') as indicated by the dashed-dotted line, heat around the heat generating resistors 801 and 802 is conducted to the ends of the heater 203, leading to more uniform temperature throughout the heater 203. As described with reference to FIGS. 10A, 10B, 10C, and 10D, however, thermal resistance leading to the thermistor unit 501 is large and the responsiveness of the thermistor unit 501 is not sufficient. Therefore, as in the case (2)' in the second exemplary embodiment, cutting out a portion of the graphite sheet 207 to allow the thermistor unit 501 to make contact with the heater 203 therethrough increases the speed of temperature detection while reducing unevenness in the temperature distribution in the widthwise direction of the heater 203.

The configurations of the image forming apparatus 100 and the fixing apparatus 118 according to a third exemplary embodiment are similar to those of the first exemplary embodiment. Identical components are given identical reference numerals, and description thereof will be omitted.

Figure 12:
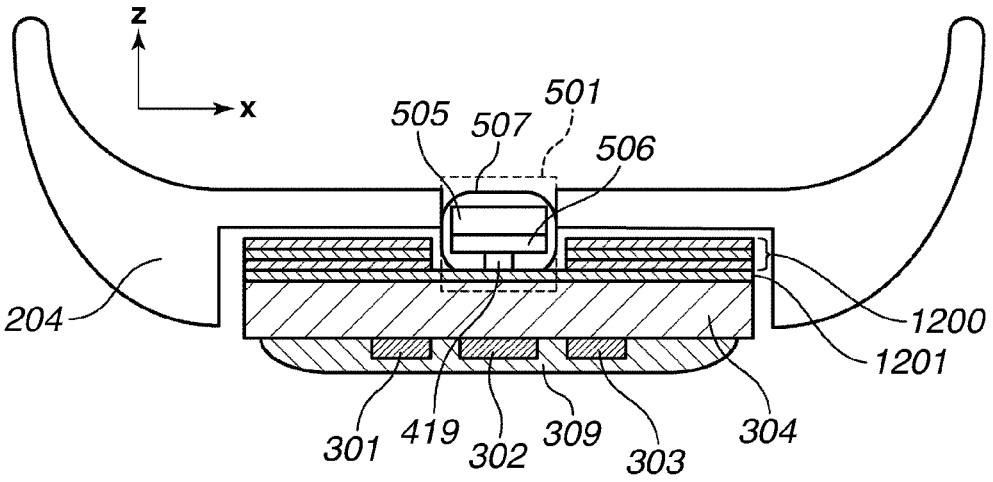
FIG. 12 is a sectional view illustrating the shape of a thermally conductive anisotropic member according to a third exemplary embodiment.

FIG. 12 is a sectional view of the fixing apparatus 118 according to the third exemplary embodiment illustrating the heater 203 and the vicinity thereof. The thermally conductive anisotropic member in the third exemplary embodiment is thinner around a portion where the temperature detection member makes contact with the thermally conductive anisotropic member than in the remaining portion. In other words, the thickness of the thermally conductive anisotropic member at a portion where the temperature detection member is disposed thereon is less than that in the area around the aforementioned portion. Furthermore, the thermally conductive anisotropic member used in the third exemplary embodiment is not a graphite sheet but is obtained by printing paste-form graphite on the ceramic heater 203 and sintering the resulting ceramic heater 203. Graphite layers 1200 are obtained through printing graphite multiple times and thus have a multilayer structure. The thermally conductive anisotropic member (graphite layers 1200 and graphite layer 1201) used in the third exemplary embodiment has a total of four layers.

The thermistor element 419 detects the temperature of the ceramic heater 203 through the lowermost graphite layer 1201. Each layer in the graphite layers 1200 and 1201 is approximately 20 μm in thickness, and thus the thickness of the graphite layers 1200 and 1201 is approximately 80 μm in the area except areas where the thermistor units 501, 502, 503, and 503 make contact therewith.

Figure 13:
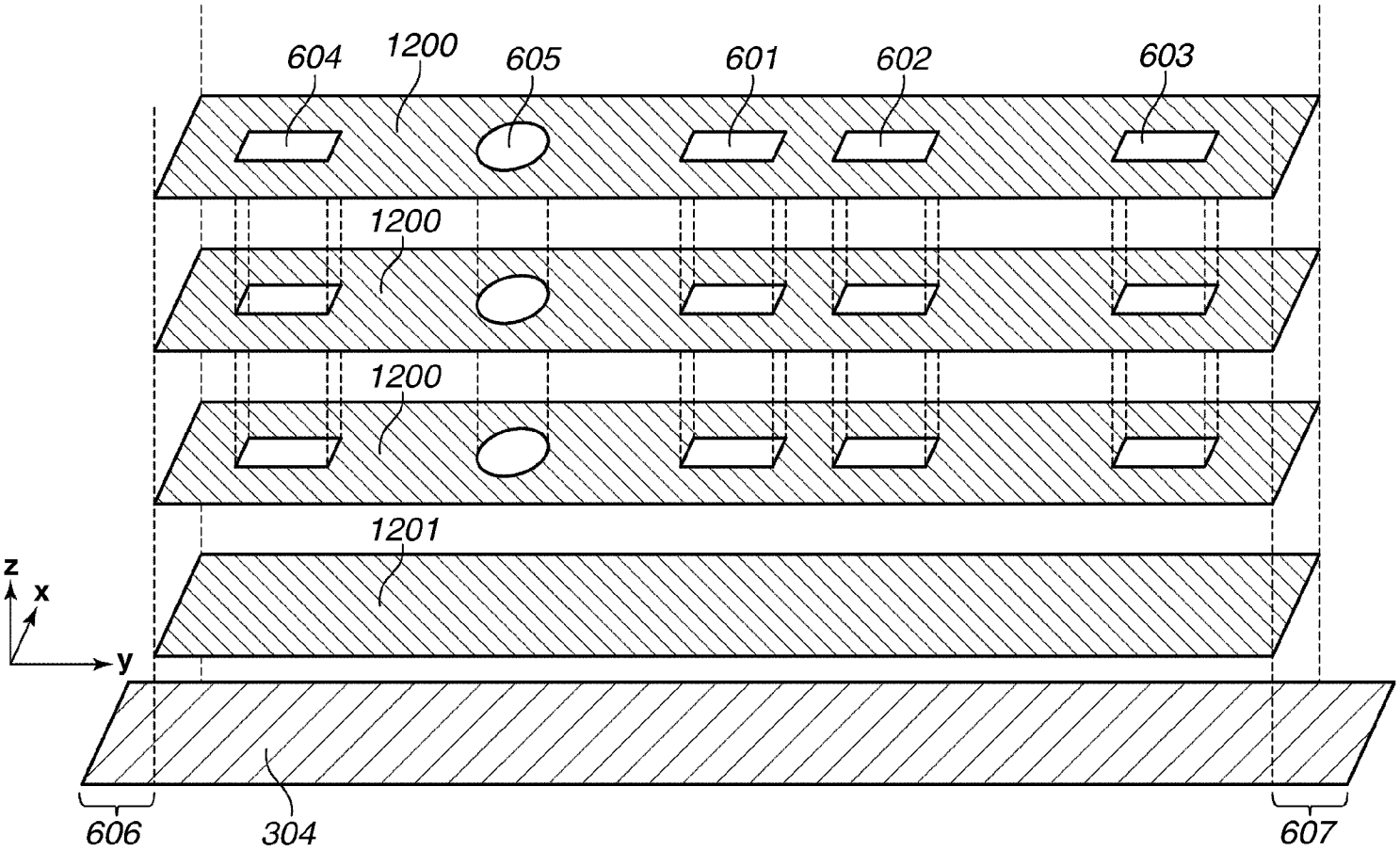
FIG. 13 is a diagram illustrating a multilayer structure of the thermally conductive anisotropic member according to the third exemplary embodiment.

FIG. 13 is a diagram illustrating the multilayer structure of the graphite layers 1200 and 1201. The lowermost layer (first layer) 1201 is formed by printing paste-form graphite across the entire surface of the heater 203 except for the portions 606 and 607 at which the heater 203 is connected to the connector. Second to fourth layers 1200 above the first layer 1201 each have the same external dimensions as the first layer 1201 and are formed by printing paste-form graphite on the first layer 1201 aside from the portions 601 to 604, through which the thermistor units 501 to 504 make contact with the first layer 1201, and the portion 605, through which the thermostatic switch 430 makes contact with the first layer 1201.

The graphite sheet 207 may be used, similarly to the first and second exemplary embodiments, and the thickness thereof may be made to differ between an area where the temperature detection member makes contact with the graphite sheet 207 and the remaining areas. Further, a thin thermally conductive anisotropic member may also be provided at a portion through which the temperature detection member is to make contact with the heater 203, as in the third exemplary embodiment, and the shape of the remaining area may take on such a shape as illustrated in FIG. 6B.

The configurations of the image forming apparatus 100 and the fixing apparatus 118 according to a fourth exemplary embodiment are similar to those of the first exemplary embodiment. Identical components are given identical reference numerals, and description thereof will be omitted. In the fourth exemplary embodiment, alternative examples of an area cut out from the graphite sheet 207 will be described in addition to those in the first and second exemplary embodiments.

As described in the first exemplary embodiment with reference to FIG. 7, if a maximum temperature location is close to the location of the thermistor element 419, the responsiveness of the thermistor element 419 increases as the area to be cut out from the graphite sheet 207 increases. However, if the temperature at the center in the widthwise direction is high and the temperatures at the ends are low, thermal stress on the ceramic heater 203 increases, leading to stress on the heater 203. Accordingly, even if the graphite sheet 207 is to be cut out at a portion where the thermistor unit 501 makes contact with the heater 203, a configuration with as less thermal stress as possible is desirable.

Figure 14A:
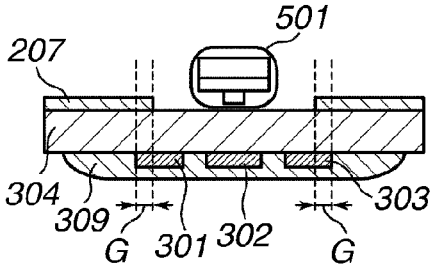
FIGS. 14A, 14B, 14C, 14D, 14E, 14F, 14G, 14H, 14I, and 14J are sectional views illustrating various shapes of the thermally conductive anisotropic member according to a fourth exemplary embodiment.
Figure 14B:
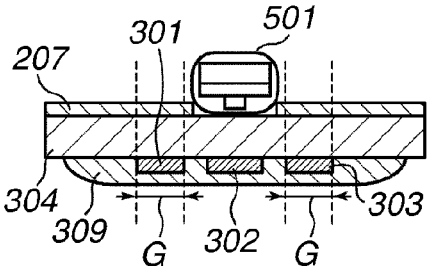
Figure 14C:
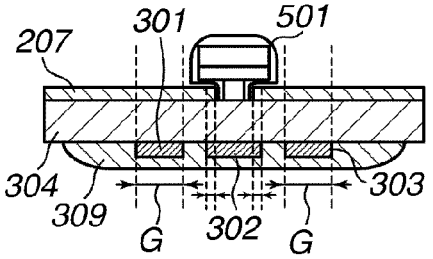
Figure 14D:
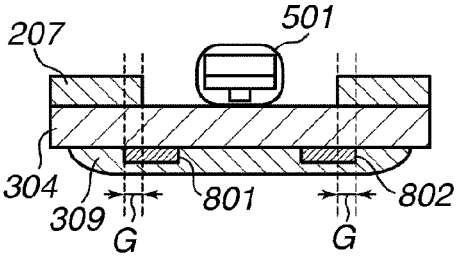
Figure 14E:
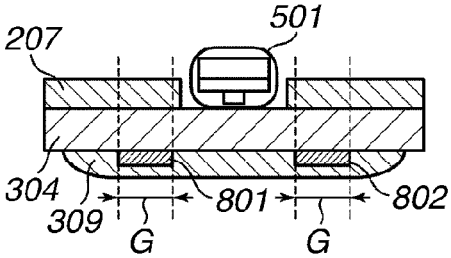
Figure 14F:
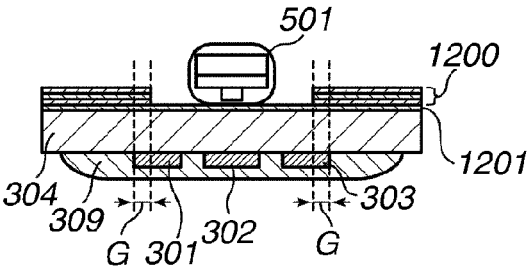
Figure 14G:
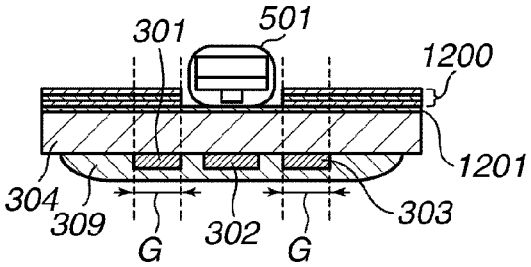
Figure 14H:
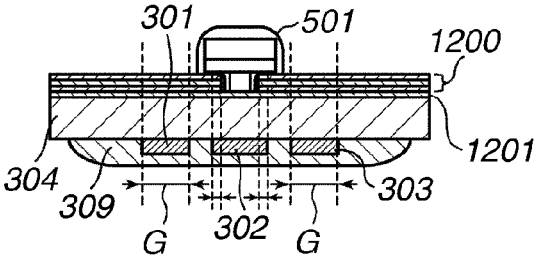
Figure 14I:
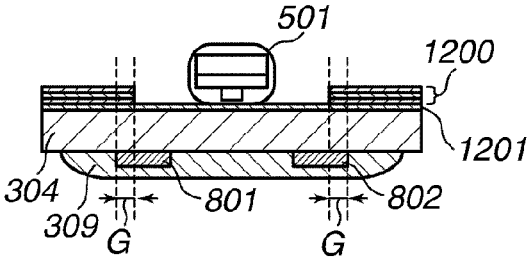
Figure 14J:
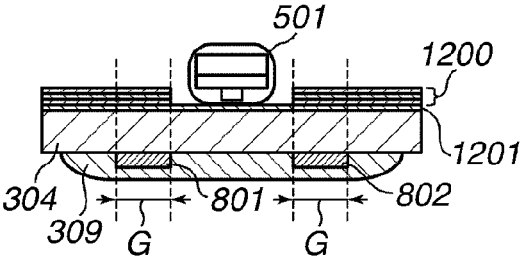

Several patterns are illustrated in FIGS. 14A, 14B, 14C, 14D, 14E, 14F, 14G, 14H, 14I, and 14J, and these are configured so that heat from the heat generating resistors 301, 302, 303, 801, and 802 is conducted toward the ends of the heater 203 in the widthwise direction as much as possible using the graphite sheet 207. The heater 203 includes a plurality of heat generating resistors provided on a substrate. As indicated by an area defined by the dotted lines, an area G is present in which the heat generating resistor located at the farthest end (heat generating resistor 301 or 303 in the example illustrated in FIG. 14A) and the graphite sheet 207 overlap each other in the widthwise direction of the heater 203. FIGS. 14A, 14B, and 14C illustrate configuration examples in heat generating patterns in the first exemplary embodiment, whereas FIGS. 14D and 14E illustrate configuration examples in heat generating patterns in the second exemplary embodiment. With such configurations, the difference in temperature between a portion where a heat generating resistor is located and the end of the heater 203 is reduced, and stress on the heater 203 is thus alleviated. FIGS. 14F, 14G, 14H, 14I, and 14J illustrate configuration examples in which the thermally conductive anisotropic member of the heater is thinner around a portion where the temperature detection member makes contact with the thermally conductive anisotropic member than that in the remaining portion, and the same configurations as FIGS. 14A, 14B, 14C, 14D, and 14E, respectively, are applied to the other parts.

According to the exemplary embodiments of the present invention, responsiveness in temperature detection can be improved while reducing the non-sheet-passing part temperature rise during fixing processing of small-sized sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-255368 filed Nov. 21, 2012, which is hereby incorporated by reference herein in its entirety.

What is claimed is:

1. An image heating apparatus, comprising:

a plate-shaped heater;

a temperature detection member configured to detect a temperature of the heater; and a thermally conductive anisotropic sheet provided on a surface of the heater where the temperature detection member is provided, the sheet having a higher thermal conductivity in a plane direction of the sheet than that in a thickness direction of the sheet, wherein the sheet is not provided at a portion of the heater where the temperature detection member is provided, or the sheet has a reduced thickness at a portion where the temperature detection member is provided compared to the thickness thereof in a surrounding area of the portion.

2. The image heating apparatus according to claim 1, wherein the sheet has an elongated shape in a longitudinal direction of the heater, the sheet including a portion through which the temperature detection member is provided, and wherein the portion of the sheet where the temperature detection member is provided is cut out, or the thickness of the sheet at the portion where the temperature detection member is provided is reduced.

3. The image heating apparatus according to claim 2, wherein the heater includes a substrate, and a plurality of heat generating resistors provided on the substrate along the longitudinal direction, wherein the portion of the sheet where the temperature detection member is provided is cut out, and wherein the sheet partially overlaps a heat generating resistor located at a farthest end in a short direction of the heater along a plane in the short direction that contains a location where the temperature detection member is provided.

4. The image heating apparatus according to claim 2, wherein the heater includes a substrate, and a plurality of heat generating resistors provided on the substrate along the longitudinal direction, wherein the thickness of the sheet at the portion where the temperature detection member is provided is less than that in the surrounding area thereof, and wherein a thicker portion of the sheet partially overlaps a heat generating resistor located at a farthest end in a short direction of the heater along a plane in the short direction that contains a location where the temperature detection member is provided.

5. The image heating apparatus according to claim 1, wherein the sheet is cut out at the portion where the temperature detection member is provided, and wherein the cut out portion extends along a longitudinal direction of the heater.

6. The image heating apparatus according to claim 1, wherein the thickness of the sheet at the portion where the temperature detection member is provided is less than that in the surrounding area thereof, and wherein a thinner portion extends along a longitudinal direction of the heater.

7. The image heating apparatus according to claim 1, wherein the temperature detection member is provided as a plurality of temperature detection members, and wherein the sheet is not provided at any portion of the heater where each of the temperature detection members is provided, or the sheet has a reduced thickness at every portion where each of the temperature detection members is provided when compared to the thickness thereof in a surrounding area of the portion.

8. The image heating apparatus according to claim 1, wherein the sheet is formed of graphite.

9. The image heating apparatus according to claim 1, wherein the sheet and the heater are separate components.

10. The image heating apparatus according to claim 1, wherein the sheet is printed on the heater.

11. The image heating apparatus according to claim 1, wherein the sheet is affixed to the heater.

12. The image heating apparatus according to claim 1, further comprising an endless belt in contact with the heater at an inner surface thereof.

13. The image heating apparatus according to claim 12, further comprising a nip portion forming member configured to form, along with the heater, a nip portion, with the endless belt provided therebetween, the nip portion nipping and conveying a recording material that carries an image.

14. A heater used in an image heating apparatus, the heater comprising:

a plate-shaped substrate; and a thermally conductive anisotropic sheet provided on the substrate, the sheet having a higher thermal conductivity in a plane direction of the sheet than that in a thickness direction of the sheet, wherein the sheet is not provided at a portion of the substrate where a temperature detection member for detecting a temperature of the heater is provided, or the sheet has a reduced thickness at a portion where the temperature detection member is provided compared to the thickness thereof in a surrounding area of the portion.

15. The heater according to claim 14, wherein the sheet has an elongated shape in a longitudinal direction of the heater, the sheet including a portion through which the temperature detection member is provided, and wherein the portion of the sheet where the temperature detection member is provided is cut out, or the thickness of the sheet at the portion where the temperature detection member is provided is reduced.

16. The heater according to claim 15, further comprising:

a plurality of heat generating resistors provided on the substrate along the longitudinal direction, wherein the portion of the sheet where the temperature detection member is provided is cut out, and wherein the sheet partially overlaps a heat generating resistor located at a farthest end in a short direction of the heater along a plane in the short direction that contains a location where the temperature detection member is provided.

17. The heater according to claim 15, further comprising:

a plurality of heat generating resistors provided on the substrate along the longitudinal direction, wherein the thickness of the sheet at the portion where the temperature detection member is provided is less than that in the surrounding area thereof, and wherein a thicker portion of the sheet partially overlaps a heat generating resistor located at a farthest end in a short direction of the heater along a plane in the short direction that contains a location where the temperature detection member is provided.

18. The heater according to claim 14, wherein the sheet is cut out at the portion where the temperature detection member is provided, and wherein the cut out portion extends along a longitudinal direction of the heater.

19. The heater according to claim 14, wherein the thickness of the sheet at the portion where the temperature detection member is provided is less than that in the surrounding area thereof, and wherein a thinner portion extends along a longitudinal direction of the heater.

20. The heater according to claim 14, wherein the temperature detection member is provided in a plurality, and wherein the sheet is not provided at any portion of the heater where each of the temperature detection members is provided, or the sheet has a reduced thickness at every portion where each of the temperature detection members is provided compared to the thickness thereof in a surrounding area of the portion.

21. The heater according to claim 14, wherein the sheet is formed of graphite.

22. The heater according to claim 14, wherein the sheet is printed on the heater.

23. The heater according to claim 14, wherein the sheet is affixed to the heater.

24. An image heating apparatus, comprising:

a plate-shaped heater;

a temperature detection member configured to detect a temperature of the heater; and a thermally conductive anisotropic sheet provided on a surface of the heater where the temperature detection member is provided, the sheet having a higher thermal conductivity in a plane direction of the sheet than that in a thickness direction of the sheet, wherein the temperature detection member is provided at a first area of the surface where the sheet is not provided, and is not provided at a second area of the surface where the sheet is provided, the temperature detection member detecting the temperature of the heater through the first area of the surface of the heater.

25. The image heating apparatus according to claim 24, wherein the sheet is formed of graphite.

26. An image heating apparatus, comprising:

a plate-shaped heater;

a temperature detection member configured to detect a temperature of the heater; and a thermally conductive anisotropic sheet provided on a surface of the heater where the temperature detection member is provided, the sheet having a higher thermal conductivity in a plane direction of the sheet than that in a thickness direction of the sheet, wherein the temperature detection member is provided on a first area of the sheet, and is not provided on a second area of the sheet, a thickness of the sheet at the first area being thinner than that at the second area.

27. The image heating apparatus according to claim 26, wherein the sheet is formed of graphite.

28. An image heating apparatus, comprising:

a plate-shaped heater;

a temperature detection member configured to detect a temperature of the heater; and a thermal conductive member provided on a surface of the heater where the temperature detection member is provided, the thermal conductive member being formed by laminating a plurality of sheets, each of the plurality of sheets having a higher thermal conductivity in a plane direction of the sheet than that in a thickness direction of the sheet, wherein the temperature detection member is provided on a first area of the thermal conductive member, and is not provided on a second area of the thermal conductive member, a thickness of the thermal conductive member at the first area being thinner than that at the second area.

29. The image heating apparatus according to claim 28, wherein the sheet is formed of graphite.

30. An image heating apparatus, comprising:

a plate-shaped heater;

a temperature detection member configured to detect a temperature of the heater; and a thermal conductive member provided on a surface of the heater where the temperature detection member is provided, wherein the temperature detection member is provided on a first area of the thermal conductive member, and is not provided on a second area of the thermal conductive member, the thermal conductive member at the second area being formed by laminating a plurality of sheets, each of the plurality of sheets having a higher thermal conductivity in a plane direction of the sheet than that in a thickness direction of the sheet, the thermal conductive member at the first area being only one sheet of the plurality of sheets.

31. The image heating apparatus according to claim 30, wherein the sheet is formed of graphite.

* * * * *